US008753145B2

(12) United States Patent
Lang et al.

(10) Patent No.: US 8,753,145 B2
(45) Date of Patent: Jun. 17, 2014

(54) GUIDE FRAME WITH TWO COLUMNS CONNECTED BY CROSS PIECES DEFINING AN OPENING WITH RETENTION MEMBERS

(75) Inventors: Harold Keith Lang, Cary, IL (US); Kent E. Regnier, Lombard, IL (US); Jerry A. Long, Elgin, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/062,986

(22) PCT Filed: Sep. 9, 2009

(86) PCT No.: PCT/US2009/056314

§ 371 (c)(1), (2), (4) Date: May 26, 2011

(87) PCT Pub. No.: WO2010/030631

PCT Pub. Date: Mar. 18, 2010

(65) Prior Publication Data

US 2011/0269338 A1 Nov. 3, 2011

Related U.S. Application Data

(60) Provisional application No. 61/095,450, filed on Sep. 9, 2008, provisional application No. 61/110,748, filed on Nov. 3, 2008, provisional application No. 61/117,470, filed on Nov. 24, 2008, provisional application No. 61/153,579, filed on Feb. 18, 2009, provisional application No. 61/170,956, filed on Apr. 20, 2009, provisional application No. 61/171,066, filed on Apr. 20, 2009, provisional application No. 61/171,037, filed on Apr. 20, 2009.

(51) Int. Cl.
*H01R 13/60* (2006.01)

(52) U.S. Cl.
USPC ..... 439/527

(58) Field of Classification Search
USPC ..... 439/352–358, 79, 372, 527, 157
See application file for complete search history.

(56) References Cited

U.S. PATENT DOCUMENTS

| | | | | |
|---|---|---|---|---|
| 5,096,441 | A * | 3/1992 | Jaag | 439/676 |
| 6,413,105 | B2 * | 7/2002 | Noro et al. | 439/157 |
| 6,488,543 | B2 * | 12/2002 | Oliphant et al. | 439/676 |
| 6,746,278 | B2 * | 6/2004 | Nelson et al. | 439/607.07 |
| 7,070,446 | B2 * | 7/2006 | Henry et al. | 439/541.5 |
| 7,553,198 | B1 * | 6/2009 | Leddy | 439/701 |
| 2001/0044228 | A1 | 11/2001 | Noro et al. | |
| 2003/0119362 | A1 | 6/2003 | Nelson | |
| 2003/0124910 | A1 | 7/2003 | Nelson | |
| 2004/0224559 | A1 | 11/2004 | Nelson | |

(Continued)

FOREIGN PATENT DOCUMENTS

| | | | |
|---|---|---|---|
| CN | 1539184 | A | 10/2004 |
| CN | 1881699 | A | 12/2006 |

(Continued)

*Primary Examiner* — Chandrika Prasad
(74) *Attorney, Agent, or Firm* — Stephen L. Sheldon

(57) ABSTRACT

A guide frame is provided that can be mounted to a circuit board and includes an opening that can receive a connector therein. The guide frame can include a pair of retention members disposed on opposing sides of the opening that are configured to couple to engagement members on the connector. The guide frame may include a flange that is configured to engage a plug connector that mates with the connector.

21 Claims, 9 Drawing Sheets

(56) References Cited

U.S. PATENT DOCUMENTS

| | | | | |
|---|---|---|---|---|
| 2005/0020134 | A1 | 1/2005 | Winings | |
| 2006/0003632 | A1* | 1/2006 | Long | 439/608 |
| 2006/0166528 | A1* | 7/2006 | Hull et al. | 439/79 |
| 2006/0216969 | A1 | 9/2006 | Bright et al. | |
| 2008/0009147 | A1 | 1/2008 | Avery | |
| 2011/0230104 | A1* | 9/2011 | Lang et al. | 439/676 |
| 2012/0034820 | A1* | 2/2012 | Lang et al. | 439/660 |

FOREIGN PATENT DOCUMENTS

| | | |
|---|---|---|
| JP | 10-092509 | 4/1998 |
| JP | 10-241790 | 9/1998 |
| JP | 2004-007045 | 1/2004 |
| JP | 2005-005168 A | 1/2005 |
| JP | 2007-095648 | 4/2007 |
| JP | 2008-103346 | 5/2008 |

* cited by examiner

GUIDE FRAME WITH TWO COLUMNS CONNECTED BY CROSS PIECES DEFINING AN OPENING WITH RETENTION MEMBERS

REFERENCE TO RELATED APPLICATIONS

This application is a national phase of international application PCT/US09/56314, filed Sep. 9, 2009 and claims priority to U.S. Provisional Appln. No. 61/095,450, filed Sep. 9, 2008; to Appln. No. 61/110,748, filed Nov. 3, 2008; to Appln. No. 61/117,470, filed Nov. 24, 2008; to Appln. No. 61/153,579, filed Feb. 18, 2009, to Appln. No. 61/170,956 filed Apr. 20, 2009, to Appln. No. 61/171,037, filed Apr. 20, 2009 and to Appln. No. 61/171,066, filed Apr. 20, 2009, all of which are incorporated herein by reference in their entirety.

BACKGROUND OF THE INVENTION

The present invention generally relates to connectors suitable for transmitting data, more specifically to guide frames used in accommodating input/output (I/O) connectors suitable for dense connector configurations.

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire at increasing performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

I/O connectors are used in both internal and external applications. In external applications, the connectors provide a port for a plug connector to connect with an electronic device. In internal applications, I/O plug-style connectors are used to connect internal electronic systems together. Quite often in such internal applications, a connector is provided on a circuit board within an electronic device, and a plug connector is used to connect to it. In order to ensure that the plug connector stays mated to the opposing connector, connector guides or guide frames are provided. A well-known problem with connecting cables to circuit board-mounted connectors is the tendency of the weight and movement of the cable to loosen the points of attachment of the connector to the circuit board, thereby breaking signal pathways and causing the circuit board to fail. Accordingly, certain individuals would appreciate an improved internal guide for a single or multiple connectors.

SUMMARY OF THE INVENTION

A guide frame can be configured to be mounted on a circuit board. The guide frame has an opening into which a connector is received. The guide frame, for ganged applications, may have a plurality of individual openings. The guide frame can include two or more columns that are configured to receive a screw or other fastening member so that in operation, the guide frame can be coupled to the circuit board. The columns can be joined together by a top cross piece and a bottom cross piece. In an embodiment, the bottom cross piece can be configured to engage a housing portion of a connector. The top cross piece can also be configured to engage the housing portion and may include openings to engage a retaining latch of a mating plug connector.

BRIEF DESCRIPTION OF THE DRAWINGS

Throughout the course of the following detailed description, reference will be made to the drawings in which like reference numbers identify like parts and in which.

DETAILED DESCRIPTION OF THE ILLUSTRATED EMBODIMENTS

As required, detailed embodiments are disclosed herein; however, it is to be understood that the disclosed embodiments are merely exemplary and the depicted features may be embodied in various forms. Therefore, specific details disclosed herein are not to be interpreted as limiting, but merely as a basis for the claims and as a representative basis for teaching one skilled in the art to variously employ the depicted features in virtually any appropriate manner, including employing various features disclosed herein in combinations that might not be explicitly disclosed herein.

Figure 1:
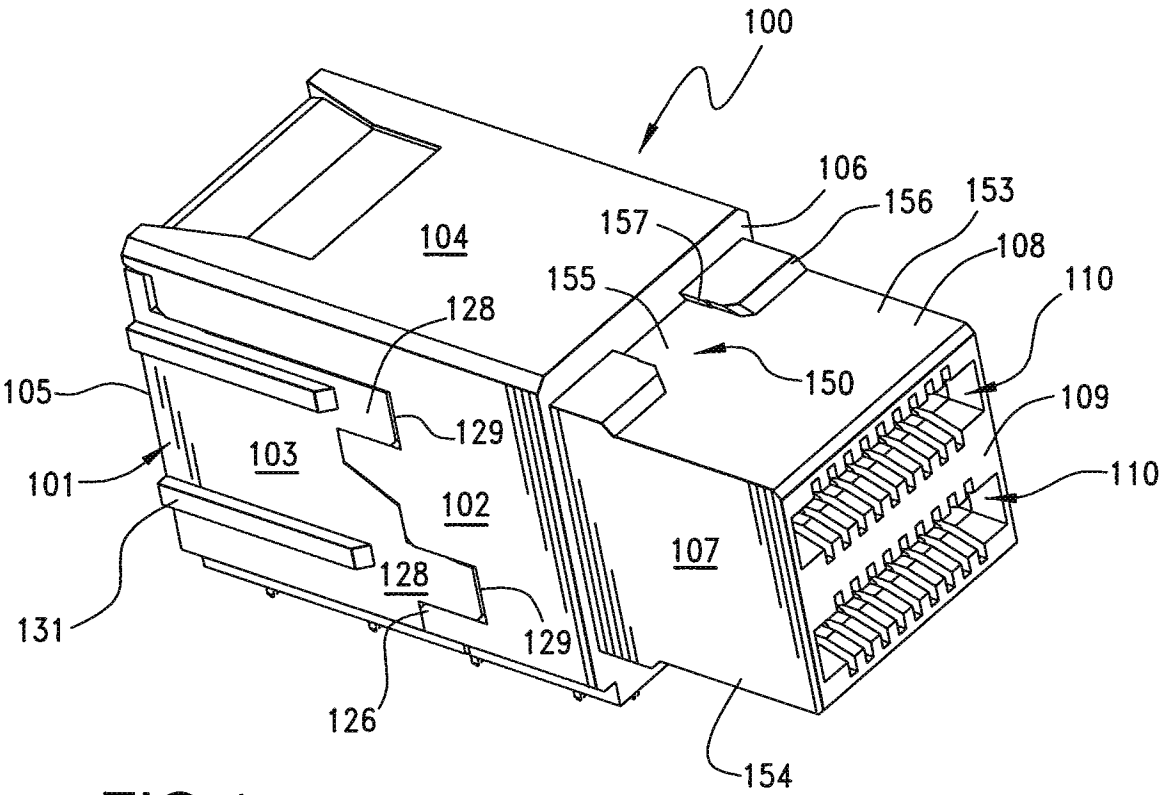
FIG. 1 illustrates a perspective view of an embodiment of a connector.

FIG. 1 illustrates a connector 100. The connector 100 has an insulative housing 101 which is illustrated as having two interengaging first and second (or front and rear) pieces, or parts 102, 103. The housing 101, as shown in FIG. 1 has a wide body portion 104 that extends between opposing front and rear faces, respectively 106 and 105. A mating portion 107 that takes the form of an elongated nose portion 108 projects forwardly of the front face 106 and terminates in a mating face 109. The mating face 109 may have one or more circuit card-receiving slots 110 that are formed widthwise in the mating face 109, with two such slots 110 being shown in FIG. 1.

Figure 2:
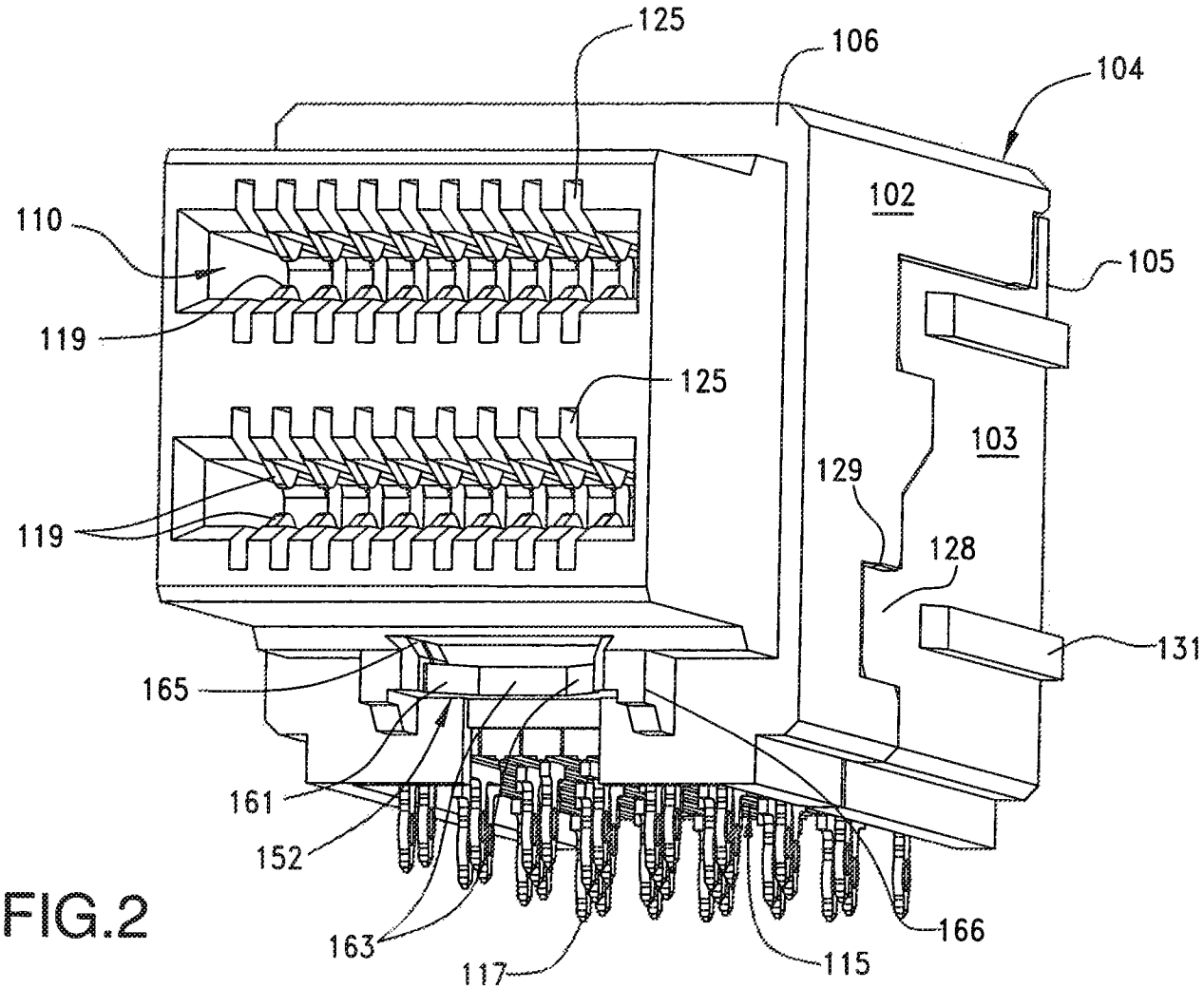
FIG. 2 illustrates a frontal perspective view of the connector of FIG. 1.
Figure 3:
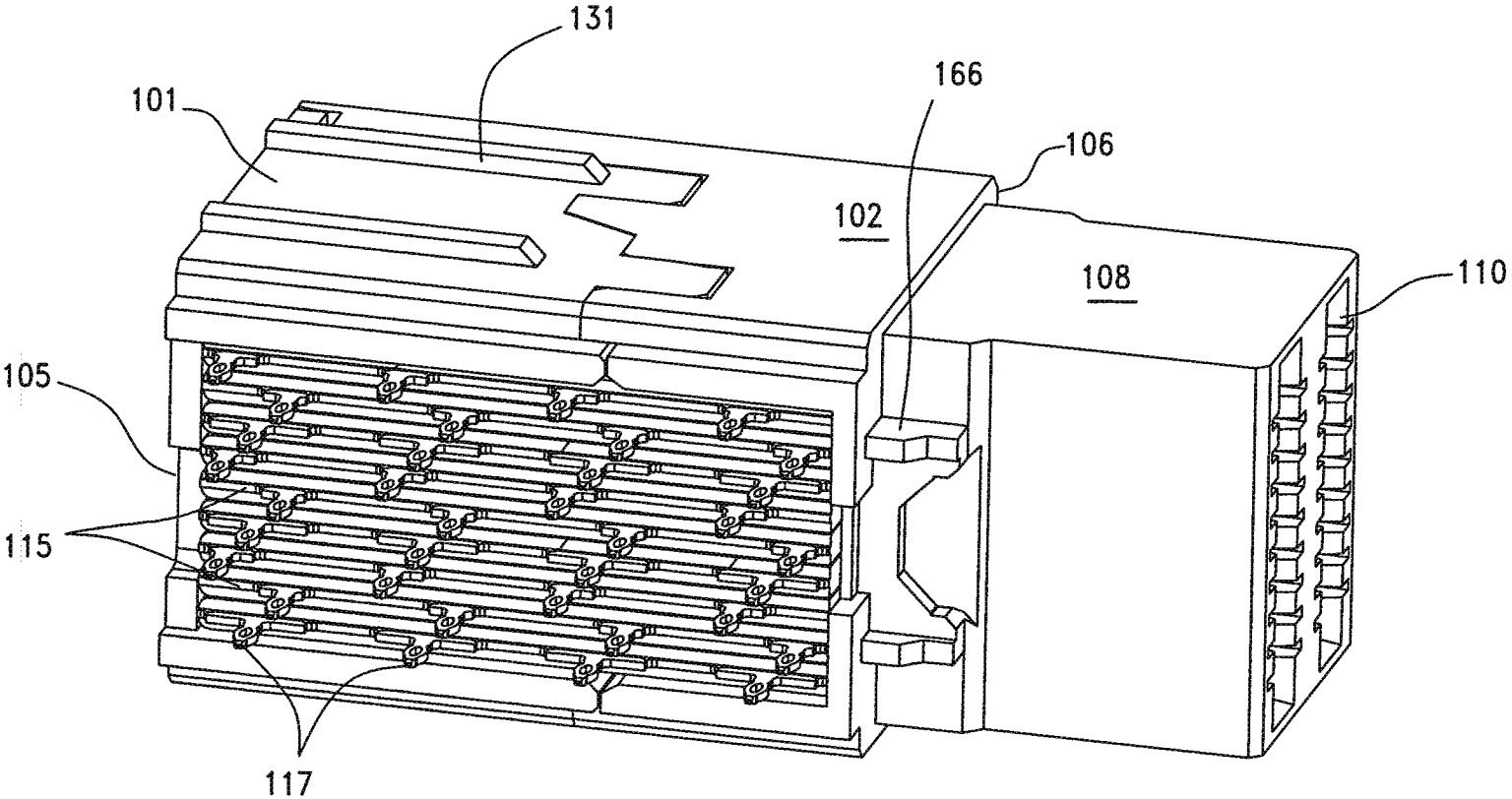
FIG. 3 illustrates a perspective view of the connector laying on its side to illustrate the terminal assemblies housed in the connector.

As shown in FIGS. 2 & 3, the housing 101 has a hollow interior portion 112 that receives a plurality of terminal assemblies that take the form of insulative connector wafers 115. Each such wafer 115 contains a plurality of conductive terminals 116 having tail portions 117 projecting out from the housing 101 along one edge 118 thereof and contact portions 119 extending within terminal-receiving cavities 125 that are formed in the connector mating face 109 In the illustrated embodiment, the two edges 118, 120 are adjacent each other.

The terminal assemblies are held together as a block within the housing 101 in a manner such that the terminal tail portions 117 extend out through the bottom of the housing 101 and the terminal contact portions 119 extend from the edges 120 of their frames 115 into the housing nose portion 108. The contact portions are arranged in the frames 115 as pairs of terminals and each pair is contained within and on opposite sides of one of the card-receiving slots 110. (FIGS. 2 & 3.) The contact portions 119 are cantilevered in their structure and act as contact beams that deflect away from the slots 110 when a circuit card is inserted therein. In order to accommodate this upward and downward deflection of the contact portions 119, the nose portion 108 of the housing 101 has terminal-receiving cavities 125 that extend a vertical preselected distance above and below centerlines of each slot 110. Preferably, as will be explained more below, the ends of the portions 124 run along a line "D" that is close to, or most preferably, substantially coincident with the deflection points "P".

Returning to FIG. 1, the housing 101 has its two pieces 102, 103 mate along an irregular mating line 126 that extends upwardly through the sides of the housing 101 along a path that extends from front to rear of the housing 101. This irregular mating line facilitates the molding of the housings and it is explained in greater detail in U.S. Provisional Patent Application No. 61/122,102, filed Dec. 12, 2008 for "Two-Piece Thin Wall Housing.", which is incorporated herein by reference in its entirety. The two housing parts 102, 103 interlock together or engage with each other along this irregular and non-linear mating line 126.

With this irregular configuration, a pair of rails 128 and channels 129 are defined in the two housing pieces 102, 103 with the rails 128 fitting into the channels 129. Outer ribs 131 may also be formed on the exterior side surfaces of the rear housing part 103 and these ribs 131 are preferably horizontally aligned with the rails 128 to provide reinforcement to the rails 128, but also to provide a means for positioning the connector subassembly 100 in a guide frame, as will be described in greater details to follow.

Figure 5:
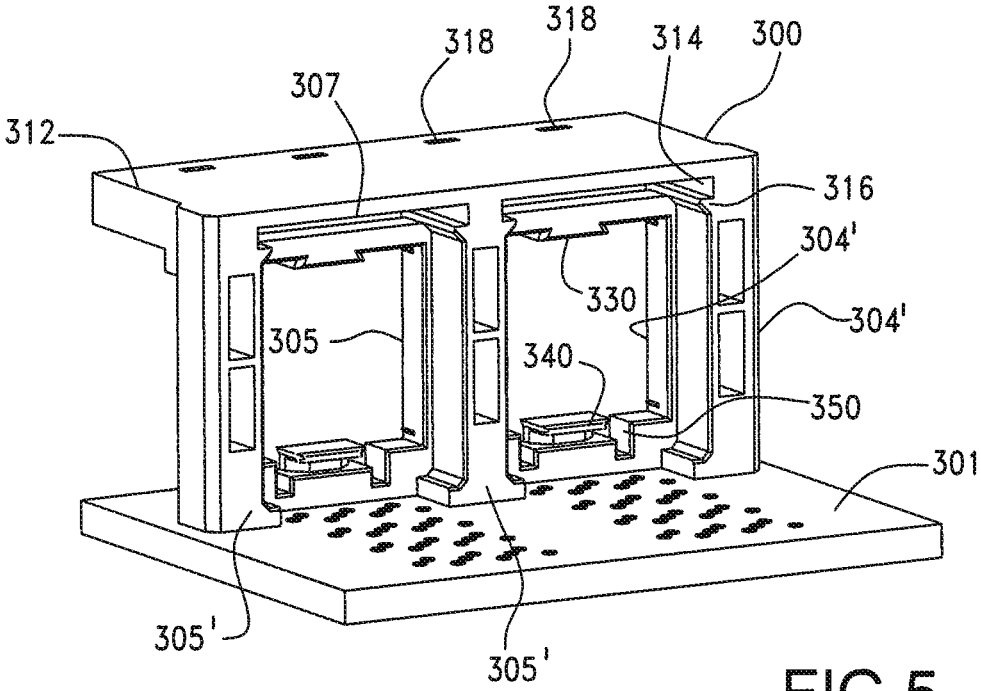
FIG. 5 illustrates a perspective view of an embodiment of a guide member.
Figure 6:
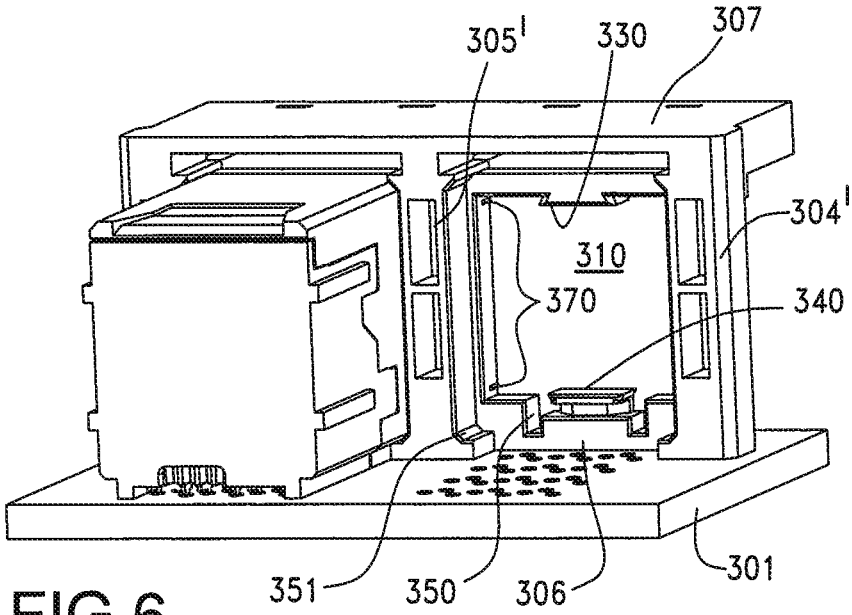
FIG. 6 illustrates a perspective view of the guide member depicted in FIG. 5 with a connector positioned in an opening in the guide member.
Figure 8:
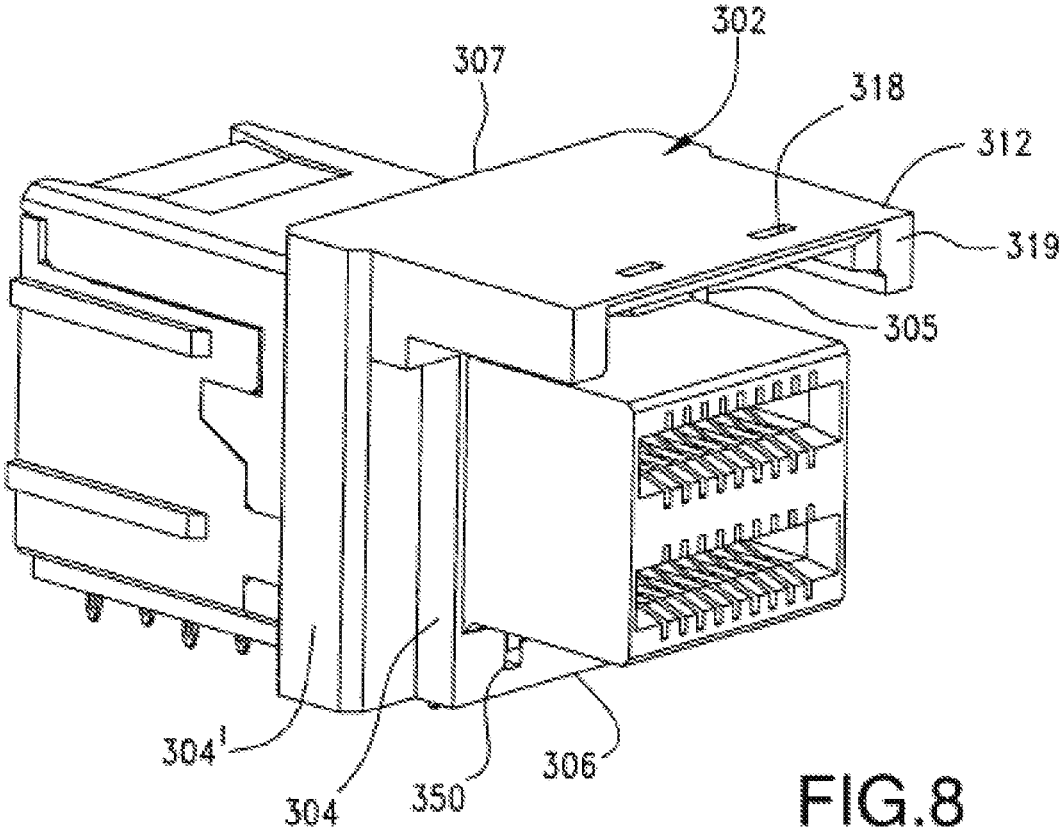
FIG. 8 illustrates a perspective view of an embodiment of a guide member coupled to a housing.

Turning now to FIGS. 5, 6 & 8, a guide frame 300 is depicted as being mounted to a circuit board 301. This guide frame 300, which can also be referred to as a shroud, is typically mounted on a circuit board within an electronic component, such as a router or server, and the guide frame 300 serves to guide a mating plug connector into engagement with the connector subassembly 100.

This guide frame 300 can be molded from a dielectric material such as a resin and may include one or more metal reinforcement members therein at selected locations. The guide frame 300 includes a frame 302 that has multiple columns and cross-pieces which are joined together to define one or more hollow interior openings. As depicted, it includes a first and second column 304, 305, a bottom cross-piece 306 and a top cross-piece 307 which are joined together to form the frame 302 and the frame may provide a rectangular which defines one or more openings 310 which extending through the guide frame 300. Each such opening 310 can be configured to receive an individual connector 100 therein in such a manner such that the frame 302 surrounds the nose portion 108 of the housing 101. As depicted, the first and second column 304, 305 respectively have a rear portion 304', 305' that extends rearwardly of the opening 310. Alternatively, the column and cross-pieces can have the same thickness so that they form edges of the opening 310 that are substantially similar. The first and second columns 304, 305 are shown with an aperture 344.

Figure 7:
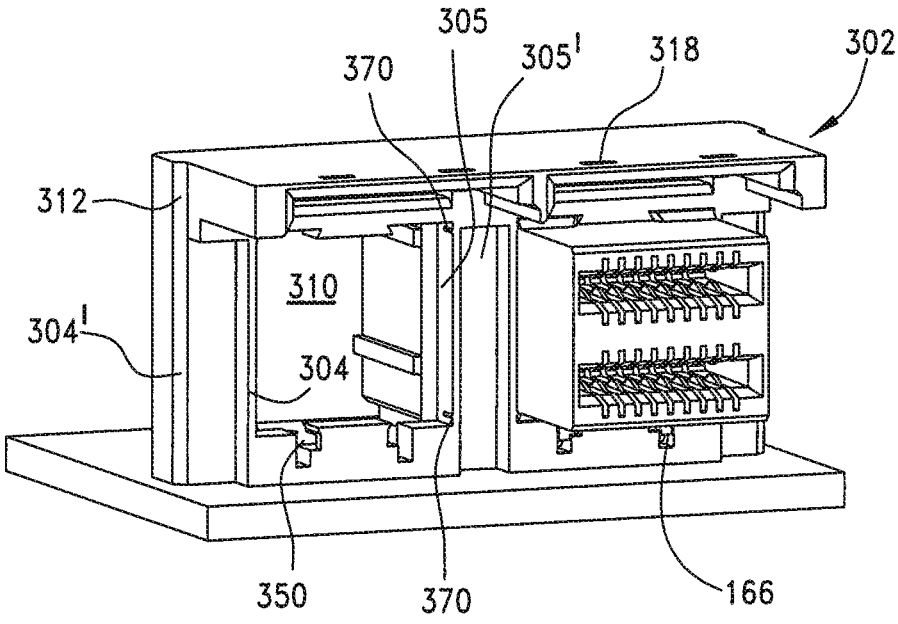
FIG. 7 illustrates another perspective view of the guide member depicted in FIG. 6.
Figure 9:
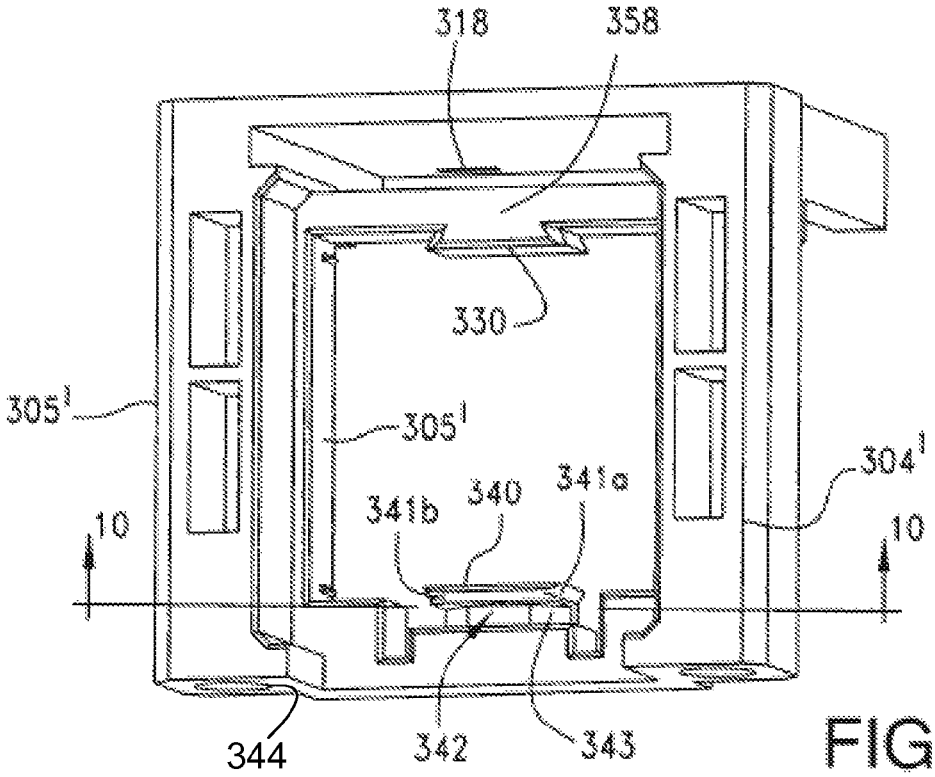
FIG. 9 illustrates a perspective view of an embodiment of a guide member.
Figure 10:
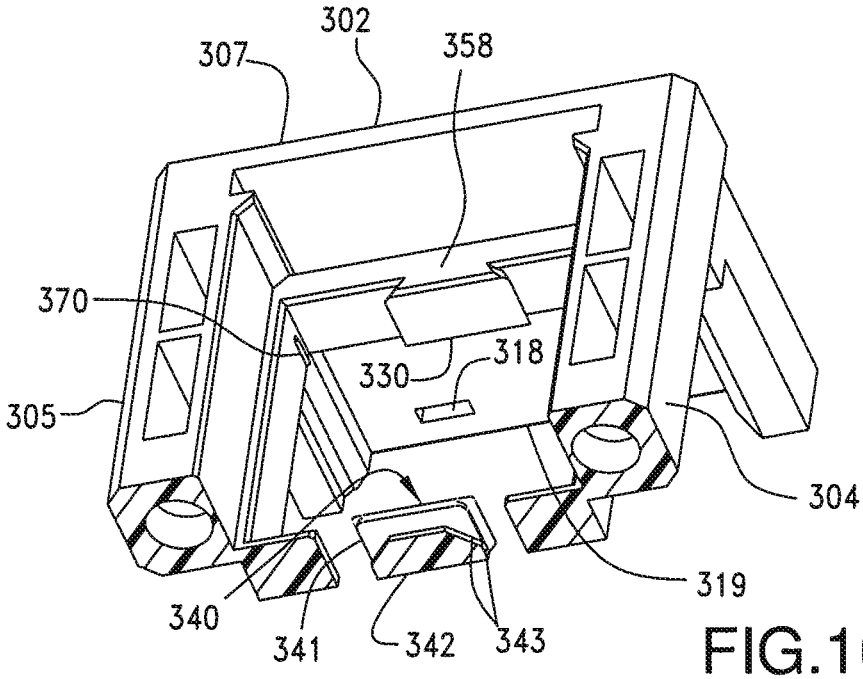
FIG. 10 illustrates a sectional view of FIG. 9, taken along lines 10-10 thereof.
Figure 9A:
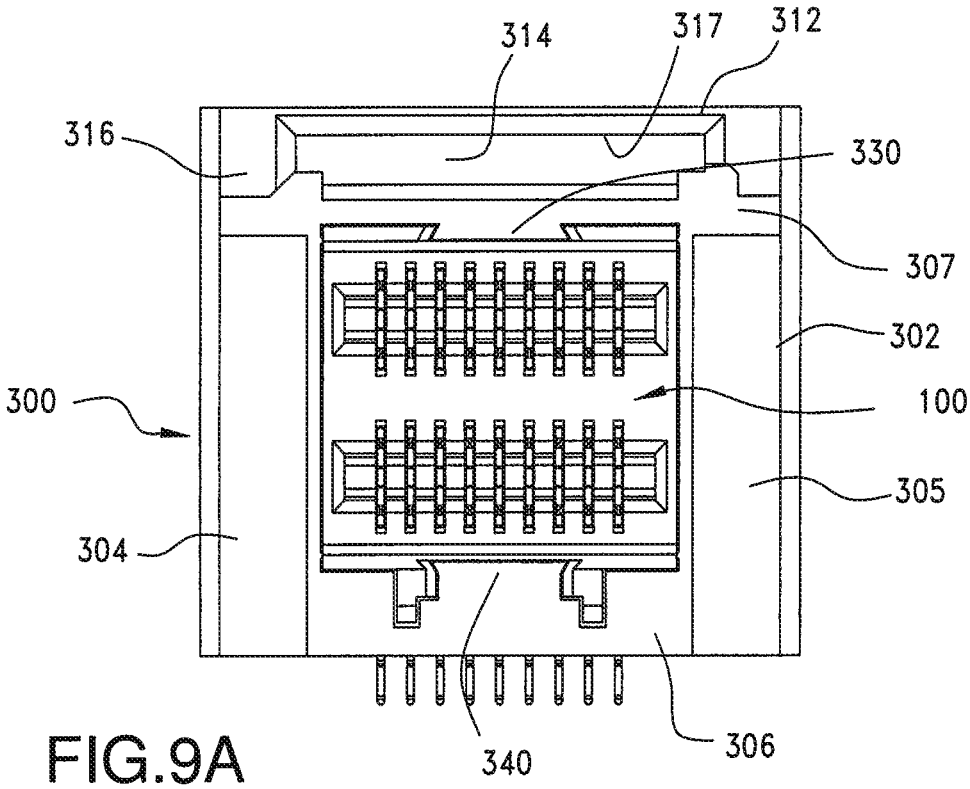
FIG. 9A illustrates a front elevational view of the guide member of FIG. 9.

The guide frame 300 may also include a flange 312 that extends out forwardly and horizontally from the first cross-piece 307. This flange 312 can be used to interact with an opposing plug connector and may include a widthwise slot 314 defined in part by two shoulders 316 that are spaced apart from each other along the front surface 317 of the top wall 307. This slot 314 can be polarized and configured to receive a key on the opposing mating connector (not shown) to ensure proper mating with the subassembly 100. The flange 312 may also include one or more notches 318 that can be disposed near the front edge 319 of the flange 312. If multiple notches are provided, they can be spaced apart widthwise of the guide frame flange 312. The notches can extend from a first surface to a second surface of the flange (such as from a top surface to a bottom surface) or they can provide a recess that extends a partial distance through the flange. The notches 318 can be positioned so as to be engaged by corresponding engagement members which are formed on the opposing mating plug connector. The guide frame 300 may be formed to engage a single connector subassembly 100 as shown in FIGS. 7, 9 & 9A, or it may have a ganged structure that is configured to engage multiple connector subassemblies 100 as shown in FIGS. 5, 8 and 11 to 13.

To help position the connector subassembly 100 in place in the internal guide frame 300, the guide frame 300 can include one or more retention members, such as depicted first and second retention member 330, 340. The retention member can be disposed on one or more sides of the opening and if two are provided then they may be positioned on opposing sides of the guide frame opening 310 so as to help distributed the forces that can be encountered in use. As depicted, the first retention member 330 extends downwardly in the opening 310 and has an end 330*a* and base 330*b* that together create an angled shape that can dovetail with an inverted angled shape. Similarly, the second retention member 340 also has an end 341*a* and a base 341*b* that form an angled configuration (the angle inverted compared to the first retention member 330) but also includes faceted portion 342. The faceted portion 342 has a plurality of flat surfaces 343 (in an embodiment more than three such as the five illustrated surfaces) that are angularly disposed with respect to each other and form the general shape of a half-hexagon or half-octagon. These flat surfaces 343 can be provided to abut against corresponding opposing surfaces of the connector 100 so as to help hold the connector in place in the guide frame 300. As depicted, these two retention members 330, 340 can be aligned with each other along a common vertical axis to help manage forces being applied to the guide frame 300 but such alignment is not required.

Figure 4:
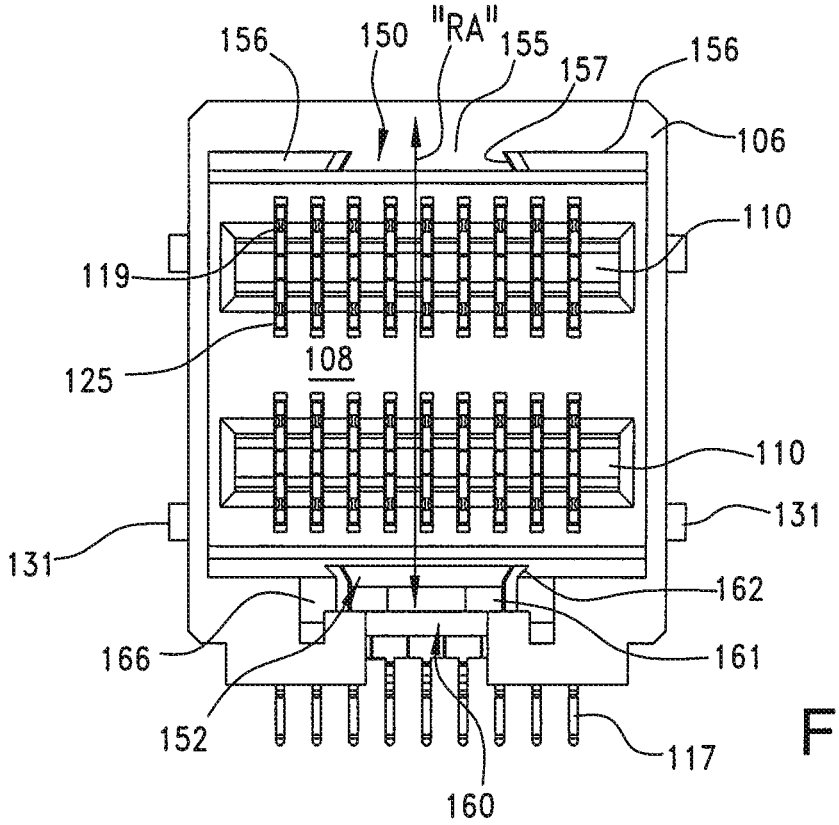
FIG. 4 illustrates a front elevational view of the connector of FIG. 1.

In order to engage the guide frame 300, the housing 101 of the subassembly 100 can include an appropriate number of first and second engagement members 150, 152. If two retention members are provided, for example, then two engagement members are useful. Embodiments of an engagement member can be appreciated from the depicted in FIGS. 1 & 2. As depicted, they are located on opposing top and bottom surfaces 153, 154 of the nose portion 108. The first engagement member 150 can take the form of a recess 155 defined by two opposing edges 157 so that the recess 155 extends widthwise between two shoulder portions 156 that are disposed on the top surface 153 of the nose portion 108. The edge 157 can be angled so as to all the edges 157 to engage the retention member in a dovetailed configuration when viewed from the front of the housing 101. (FIG. 4).

Similarly, the housing 101 also includes a second engagement member 152 also in the form of a recess 160 that is disposed on the bottom surface 154 of the housing nose portion 108. This recess 160 can be aligned with the upper recess 155 along a common, vertical axis RA. (FIG. 4). The recess 160 has two distinct sections 161, 162. The first section 161 has a plurality of flat surfaces 163 (i.e., is multi-faceted) that are disposed adjacent each as shown in FIG. 2. The flat surfaces 163 are interconnected together to form a half-octagonal opening (FIG. 3) and they abut the confronting flat surfaces 343 of the bottom retention member 340 of the internal guide frame 300 when the connector 100 is fully inserted into the guide frame 300. These flat surfaces 163, 343 help prevent rotation of the housing 101 with respect to the guide frame 300. It can be seen that the first and second retention members 330, 340 are similar in configuration, both are angled and are wider at their ends and are oriented so as to allow dovetail joints that are inverted in orientation. It should be noted that while the inverted orientation has been determined to be simpler to manufacture and there is beneficial, such inversion is not required.

The second engagement member 152 of the housing 101 further includes a top section 162 that takes the form of a widthwise slot 165 that communicates with the bottom section 161. As shown in FIGS. 2 & 4, this slot 165 allows a dovetailed configuration, and one that is inverted as compared to the top recess 156, i.e. it is wider at its top edge than at its bottom edge. Two legs, or longitudinal rails, 166 may be provided that flank the bottom recess 152 and they serve to provide structural support for the molding of the bottom engagement member 152 and they may also project into two channels 350 that are formed in the second cross-piece 306. Additional engagement points such as internal shoulders 351 that bear against the housing 101 may also be provided on the guide frame 300. Other features that can be used to secure the connector 100 in the guide opening 310 include one or more longitudinal crush ribs 370 which will bear against the housing 101 when it is inserted into the guide opening 310. The crush rib 370 can be positioned on one side and in operation becomes deformed during the insertion process. For more uniform forces, however, it has been determined that placing a crush rib on opposing sides of the opening has certain benefits.

The front face 106 of the housing 101 provides a stop surface that contacts the inner surface of the retention member 330 to fix the location of the housing 101 in the guide frame. The multiple flat surfaces 343 of the lower retention member 340 also assist in this function. It can be seen that the retention members of the internal guide frame 300 and the engagement members of the housing act cooperate to form a means for reliably engaging the guide frame and connector subassembly together.

Figure 11:
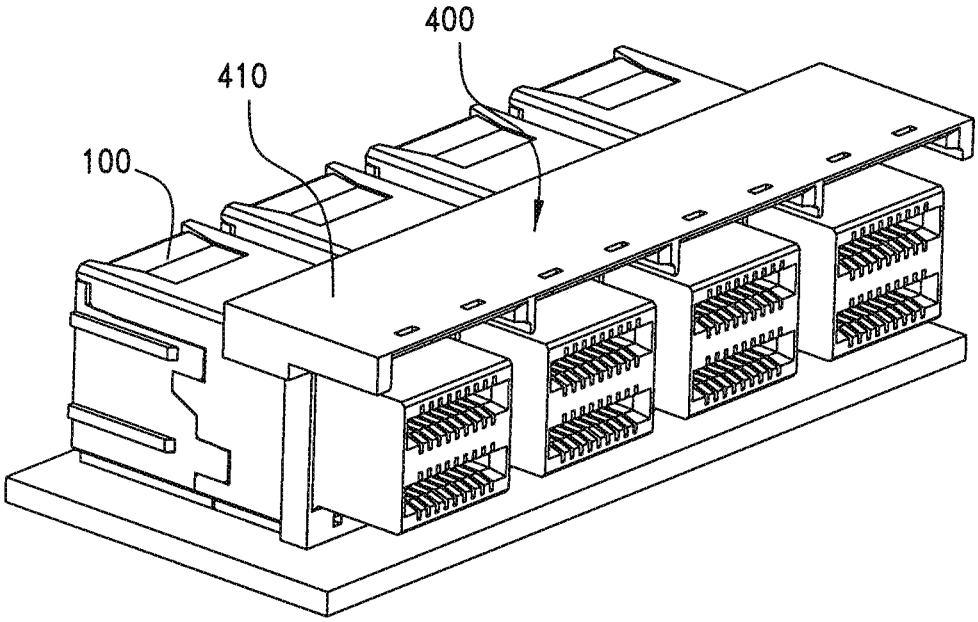
FIG. 11 illustrates a perspective view of a ganged guide member with four connectors positioned in individual guide openings.
Figure 12:
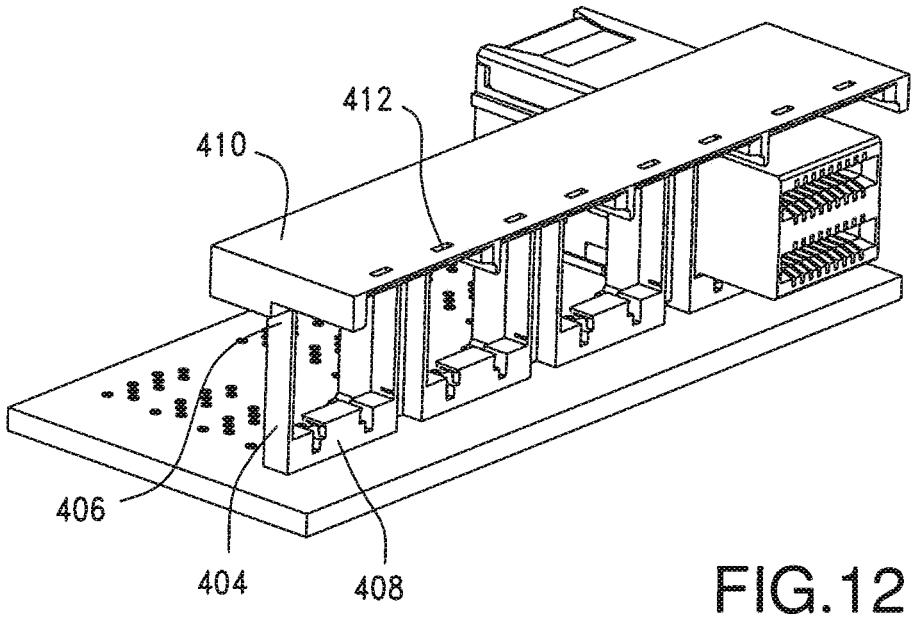
FIG. 12 illustrates a ganged guide member with one connectors inserted; and, FIG. 13 illustrates another perspective view of the ganged guide member depicted in FIG. 12.
Figure 13:
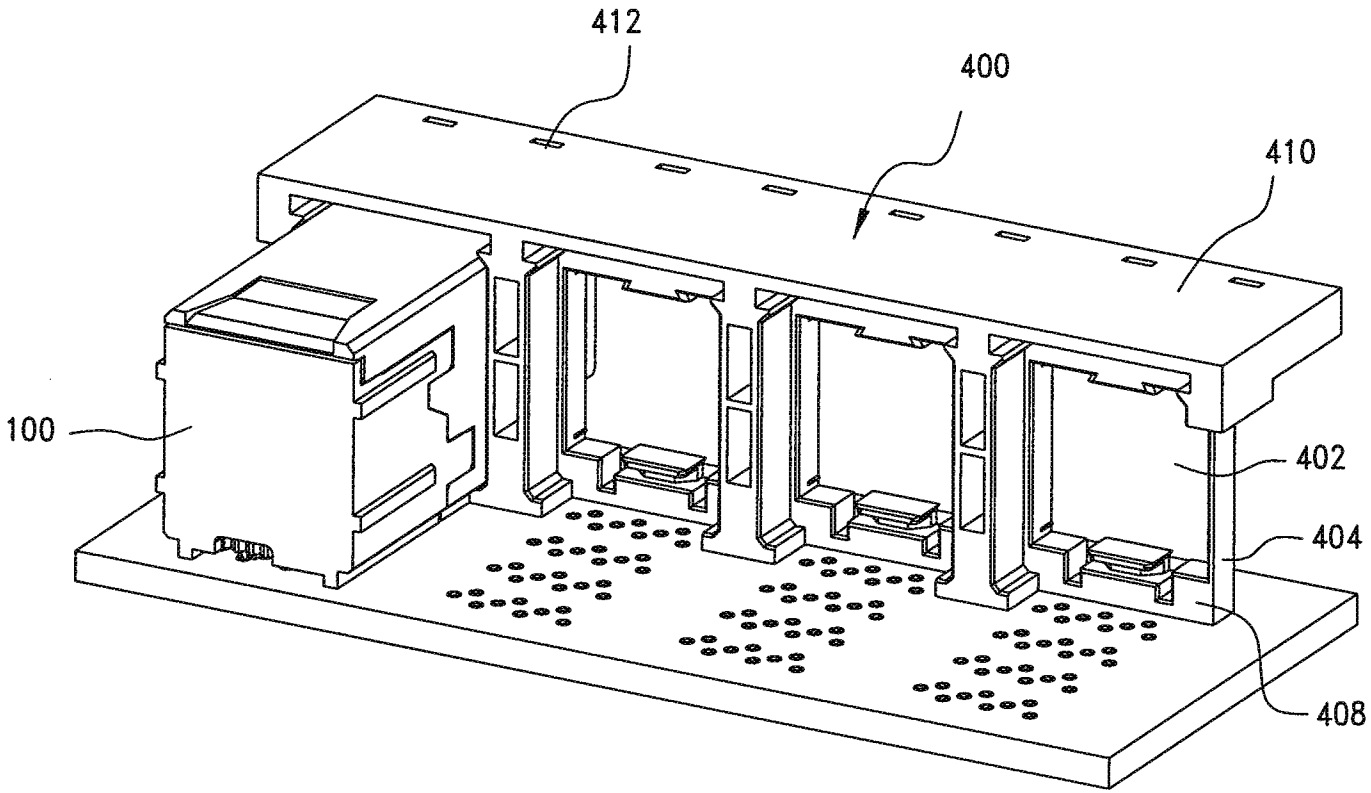

FIGS. 11-13 illustrate and 1×4 ganged guide 400, which has four openings 402 that accommodate a single connector 100 each. In this embodiment, as in the earlier embodiments, some of the openings are defined by two columns that can be attached to the circuit board but instead include a wall 404 coupled to a column by first cross-piece 406 and second cross-piece 408. As depicted, the flange 410 extends over the full width of the guide 400 and is associated with each opening 402. The flange 410 includes notches 412 (which as discussed above, may be apertures) disposed therein for engagement by an opposing plug connector (not shown). Although two such flange openings 412 are shown aligned for each guide opening 402, it will be understood that the number of notches on the flange 410 will depend on the engagement structure of the plug connector used with the guide frame.

As can be appreciated, the depicted features provide a way to secure both the internal and plug connectors in place within an electronic device, by not only providing a structure into which the internal connector may be inserted, but also by providing a frame with means that engage the opposing plug connector and orient it in a proper mating position in opposition to the connector. Hence, guide frames and guide members of the present invention may be considered as bi-directional guides that serve to fix the position of both plug and connectors.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations. These modifications and/or combinations fall within the art to which this invention relates and are intended to be within the scope of the claims, which follow. It is noted, as is conventional, the use of a singular element in a claim is intended to cover ne or more of such an element.

What is claimed is:

1. A guide frame for mounting on a circuit board, comprising:

a first and a second column, the first and the second column spaced apart;

a top cross piece joining the first and the second column;

a bottom cross piece joining the first and the second column, the first and second columns, the top cross piece and the bottom cross piece forming an opening that includes four sides; and a first and a second retention member positioned on opposite sides of the opening, wherein at least one of the columns is configured to be mounted to a supporting circuit board.

2. The guide frame of claim 1, wherein the first retention member is disposed on the top cross piece and the second retention member is disposed on a bottom cross piece.

3. The guide frame of claim 2, wherein the first and the second retention member each have an end portion with a first width and a base portion with a second width, the first width being larger than the second width.

4. The guide frame of claim 3, wherein the base of the second retention member is multi-faceted.

5. The guide frame of claim 2, wherein the first and the second retention member are positioned along a common vertical axis.

6. The guide frame of claim 2, wherein at least one of the first and second retention members has an angled dovetail shape.

7. The guide frame of claim 1, wherein the guide frame is configured to support a first connector mounted on a circuit board, the guide frame further comprising a flange that extends forward of the opening, the flange including an engagement portion for engaging an opposing second connector.

8. The guide frame of claim 7, wherein the engagement portion includes a notch disposed in the flange.

9. The guide frame of claim 1, further comprising a first and a second crush rib in the opening, the first and second crush ribs positioned on opposite sides of the opening.

10. A connector system, comprising:

a connector including a housing with an elongated nose portion that includes a card receiving slot, the housing supporting a plurality of wafers, the plurality of wafers each supporting two terminals that are aligned with opposing sides of the card-receiving slot, the connector configured so that each terminal includes a tail and, in operation, the tails of the terminals are configured to be inserted into vias of a supporting circuit board; and an insulative guide frame supporting the connector, the guide frame including a first and a second column spaced apart and coupled by a top and a bottom cross piece, the first and second columns and the top and bottom cross pieces forming an opening with four sides, the guide frame further including a first and a second retention member positioned on opposite sides of the opening, wherein the connector is configured so that the nose portion is securely supported by the guide frame and positioned in the opening.

11. The system of claim 10, wherein the first retention member is disposed on the top cross piece and the second retention member is disposed on a bottom cross piece and the first and the second retention member each have an end portion with a first width and a base portion with a second width, the first width being larger than the second width.

12. The system of claim 10, wherein the opening is a first opening, the guide frame further including a second opening supported by at least one of the first and the second column, the second opening including a third and a fourth retention member positioned on opposite sides of the second opening.

13. The system of claim 12, wherein the guide frame includes a flange that extends above both the first and the second opening, the flange extending forward of the first and second openings.

14. The system of claim 12 wherein the connector with the housing comprises a first connector with a first housing, the system further comprising a second connector with a second housing that is distinct from the first housing, the second housing positioned in the second opening.

15. A guide frame, comprising:

a first and a second column spaced apart, the first and the second column each configured to be secured to a circuit board with a fastener;

a top cross piece;

a bottom cross piece, the first and the second columns, the top cross piece and the bottom cross piece providing a frame with an opening that includes four sides;

a first and a second retention member positioned on two sides of the opening; and a flange surface supported by and positioned above the frame, the flange surface configured to engage a retaining latch of a mating connector.

16. The guide frame of 15, wherein the flange surface is on a flange and the flange includes at least one notch that extends at least partially between the flange surface and a bottom surface of the flange.

17. The guide frame of claim 15, wherein the flange surface includes at least two notches that extend between the flange surface and a bottom surface.

18. The guide frame of claim 15, wherein the first and the second retention member having opposing dovetail shapes.

19. The guide frame of claim 15, wherein the top cross-piece is a first top-cross piece and the bottom cross-piece is a first bottom cross-piece, the guide-frame further comprising a wall coupled to the first column by a second top cross-piece and a second bottom cross-piece, the wall, the second top and bottom cross piece and the first column defining a second opening.

20. The guide frame of claim 19, wherein the flange extends forward of both the first and the second opening.

21. The guide frame of claim 15, wherein the flange surface is on a flange and a slot is provided between the flange and the top cross-piece, the slot configured to receive a key provided on a mating plug connector.

* * * * *